United States Patent [19]

Aiken et al.

[11] 4,325,921

[45] Apr. 20, 1982

[54] WASTE GAS PURIFICATION SYSTEMS AND METHODS

[75] Inventors: John E. Aiken, Monroeville Borough; William J. Didycz, Whitehall Borough, both of Pa.

[73] Assignee: United States Steel Corporation, Pittsburgh, Pa.

[21] Appl. No.: 147,459

[22] Filed: May 7, 1980

Related U.S. Application Data

[63] Continuation-in-part of Ser. No. 8,678, Feb. 2, 1979, Pat. No. 4,238,460.

[51] Int. Cl.[3] ..... B01D 53/36

[52] U.S. Cl. ..... 423/210; 423/245; 423/247; 422/111; 422/112; 422/177; 260/346.76

[58] Field of Search ..... 423/210, 220, 245, 247; 422/105, 107, 108, 110, 111, 112, 113, 115, 117, 118, 177, 187, 179; 260/346.76

[56] References Cited

U.S. PATENT DOCUMENTS

| | | | |
|---|---|---|---|
| 1,418,246 | 5/1922 | Frazer et al. | 423/247 |
| 1,422,211 | 7/1922 | Lamb | 423/245 |
| 2,785,960 | 3/1957 | Ribble et al. | 422/112 |
| 3,211,534 | 10/1965 | Ridgway | 423/213.5 X |
| 3,222,140 | 12/1965 | Scivally et al. | 422/115 |
| 3,273,971 | 9/1966 | Baddorf et al. | 422/115 |
| 3,579,308 | 5/1971 | Gower | 422/112 |
| 3,789,104 | 1/1974 | McCauley | 423/210 C |
| 4,003,979 | 1/1977 | Kanno | 423/247 |
| 4,203,943 | 5/1980 | Gillis et al. | 422/110 |
| 4,209,491 | 6/1980 | Rich | 422/112 |
| 4,238,460 | 12/1980 | Aiken et al. | 423/247 |
| 4,241,020 | 12/1980 | Grantham | 422/115 |
| 4,255,387 | 3/1981 | Gardner | 422/117 |

*Primary Examiner*—Earl C. Thomas

*Attorney, Agent, or Firm*—W. Gary Goodson

[57] ABSTRACT

Systems and methods for directing waste gases to a by-pass conduit from a conduit to a waste gas purifier in response to signals indicating predetermined conditions which are harmful to the waste gas purifier to which the waste gases are normally directed while at the same time maintaining a substantially uniform pressure at the source of the waste gases. Preferably, the source of the waste gases is a scrubber unit for a maleic anhydride production unit. The waste gas purifier is preferably a catalytic oxidation unit for oxidizing hydrocarbons and carbon monoxide in the waste gases.

16 Claims, 2 Drawing Figures

WASTE GAS PURIFICATION SYSTEMS AND METHODS

This application is a continuation-in-part of our copending application, Ser. No. 8,678, filed Feb. 2, 1979, now U.S. Pat. No. 4,238,460.

BACKGROUND OF THE INVENTION

1. Field of the Invention

This invention relates to air pollution control. More specifically, the invention is directed to systems and methods for insuring oxidation for oxidizable materials in waste gas streams, and particularly by means of a waste gas purifier such as a catalytic oxidation unit. More particularly, the invention relates to systems and methods for protecting the waste gas purifier from certain predetermined harmful conditions.

2. Description of the Prior Art

Considerable effort has gone into removing harmful materials present in waste gas streams such as would be present in industrial plants such as those waste gases produced in the production of maleic anhydride. In developing waste gas purification units for such waste gas streams, one problem that commonly arises is that the purification unit can be seriously damaged or destroyed by unusual amounts of impurities in waste gas streams, too high of a temperature in the waste gas stream, too high of a pressure in the waste gas stream, or the like.

Systems for diverting the waste gas stream from the purification unit upon detection of one of these harmful conditions to the purification unit has been developed in the past for applications such as the purification of exhaust gases from internal combustion engines, such as is taught in U.S. Pat. No. 3,273,971, incorporated herein by reference. However, these prior art systems such as that of U.S. Pat. No. 3,273,971 are not acceptable when applied to systems wherein the source of the waste gases is a pressure sensitive source such as a scrubber unit from a maleic anhydride plant. Pressures above about 5 psig will cause damage to equipment in the system. On the other hand, rapid loss of pressure results in process failure due to entrainment of liquid in the waste gas stream and resulting problems due to venting of the entrained liquid, damage to the scrubber unit, and/or damage to the waste gas purification unit.

SUMMARY OF THE INVENTION

The systems and methods of this invention which overcome the above discussed and numerous other disadvantages and deficiencies of the prior art relate to a system comprising:

(1) a pressure sensitive source of a waste gas stream, (2) a first waste gas stream conduit having its inlet end connected to the source of the waste gas stream and downstream to a waste gas purifier, (3) a second waste gas stream by-pass conduit having its inlet end connected to the source of the waste gas stream, (4) valve means for controlling the waste gas stream flow through the first and second conduits, (5) means responsive to one or more predetermined conditions harmful to the waste gas purifier to adjust the valve means to a by-pass condition to stop the flow of waste gases to the waste gas purifier and cause the waste gases to flow through the by-pass conduit, such means comprising means for adjusting the valve means in a predetermined manner which maintains a substantially uniform pressure in the pressure sensitive source of the waste gas stream.

Preferably, the pressure sensitive source of a waste gas stream is a scrubber unit for a maleic anhydride production unit. The waste gas purifier is preferably a catalytic oxidation unit for oxidizing hydrocarbons and carbon monoxide in the waste gases.

In a preferred embodiment, the valve means for controlling the waste gas stream flow through the first and second conduits comprises separate valves in each of these conduits. Also, the means responsive to one or more predetermined conditions harmful to the catalytic oxidation unit to divert the waste gas stream to a by-pass conduit comprises means for adjusting the valve means in a predetermined manner which maintains a substantially uniform pressure in the scrubber unit. Also, the means for adjusting the valve means is programmed to initiate the opening of the valve in the by-pass conduit, which in turn triggers the closing of the valve in the conduit to the catalytic oxidation unit. The opening of the valve the balance of the way in the by-pass conduit is then speeded up, preferably by triggering from a predetermined loss of instrument air pressure. This preferred embodiment thus makes possible the diversion of the waste gas stream to the by-pass conduit very rapidly and yet very simply while maintaining the pressure substantially uniform.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 2:
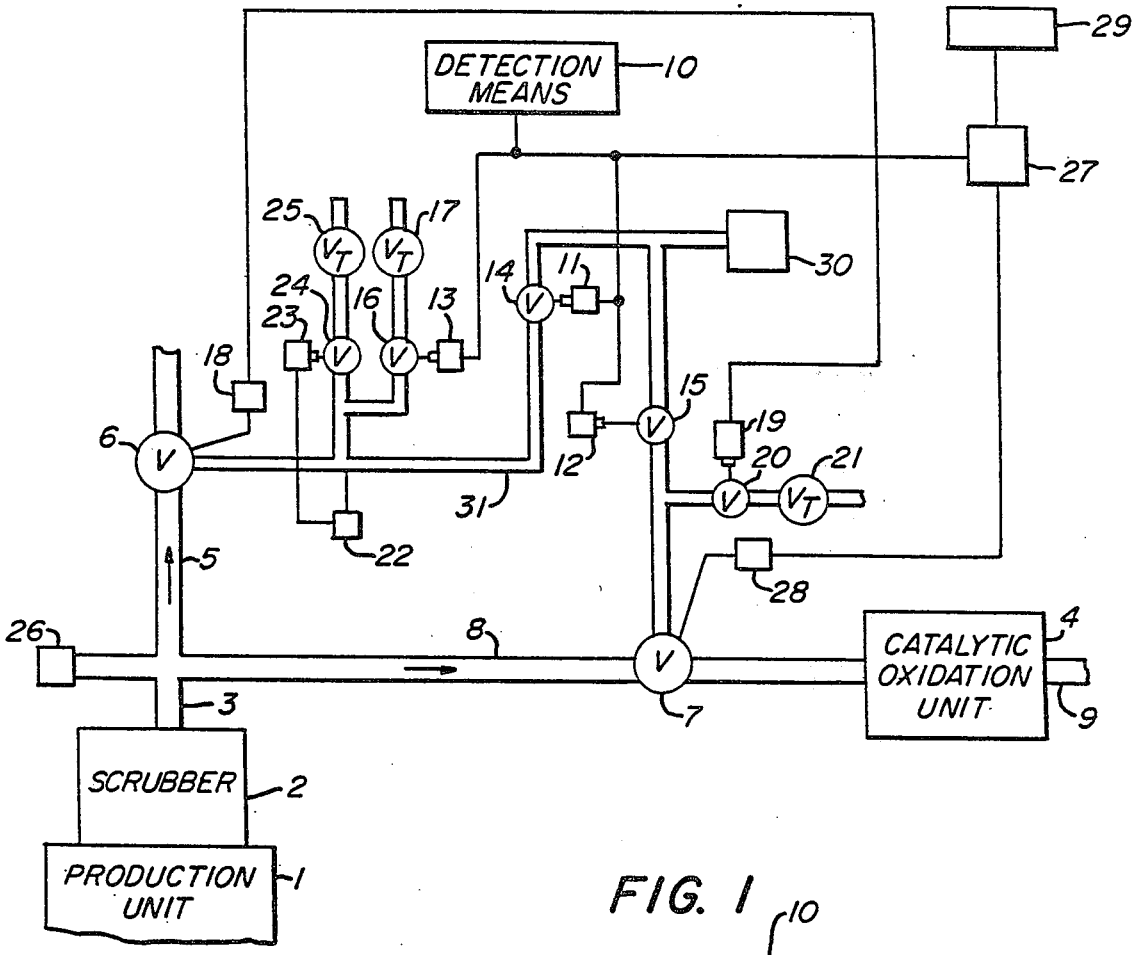
FIG. 2 is a schematic representation of a preferred waste gas purification system and method including details of the control circuitry and system.

The waste gas stream of this invention may be any of those containing impurities which may be removed by a waste gas purification unit. However, the invention is particularly directed to those waste gas streams containing oxidizable pollutants such as hydrocarbons and carbon monoxide. Exemplary hydrocarbons found in the preferred waste gas streams are benzene, maleic acid, formic acid, and formaldehyde. One exemplary waste gas stream contains the following amounts of impurities in pounds per hour per 200,000 pounds per hour of waste gas: benzine—117, maleic acid—21, formic acid—17, formaldehyde—75, and carbon monoxide—3340.

In general, the class of pollutants may be those selected from the group $C_1$–$C_{10}$ aliphatic and aromatic hydrocarbons and partially oxygenated $C_1$–$C_{10}$ aliphatic and aromatic hydrocarbons. to maintain temperature of the catalyst during use between about 140° C. and about 540° C. Temperatures above about 540° C. can result in rapid degradation of the catalyst.

Conditions which are harmful to the waste gas purification system can be any impurity, liquid, solid, temperature, pressure, or the like, which would be deleterious to the system. In temperature sensitive waste gas purification units, such as the hopcalite catalyst unit, it is important to sense when the temperature in the waste gas stream rises to a certain maximum value, and when a certain maximum level of oxidizable pollutants is reached in the waste gas stream which level would result in harmful overheating of the catalyst when the waste gas stream enters the waste gas purification unit.

Additionally, it is important to sense certain maximum pressures or losses of liquid in the scrubber unit which might result in eventual damage to the waste gas purification unit.

In the preferred hopcalite oxidation catalyst system, one of the variables to be sensed is the temperature of the catalyst bed. Another variable to be sensed is the pressure of the gas stream in the scrubber unit, and which scrubber unit is the source of the gas stream and which gas stream is fed directly from the scrubber unit to the catalyst bed. An additional variable sensed is the amount of liquid reflux flowing within the scrubber unit.

The substantially uniform pressure desired during the diversion of the waste gas stream to the by-pass conduit is such as the rate of flow of the waste gas stream through the scrubber unit does not increase by more than about 50 percent and the pressure in the unit is not greater than about 50 psig. More preferably, the rate of flow of the waste gas stream does not increase by more than 10 percent, and the pressure in the unit is not greater than about 5 psig.

The means responsive to one or more predetermined conditions should desirably have the capability of sensing the harmful conditions and adjusting the valve means to stop the flow of waste gases to the waste gas purifier and cause the waste gases to flow through the by-pass conduit in a time period of less than about 30 seconds, preferably less than about 10 seconds, and more preferably less than about 5 seconds.

In the preferred system of this invention the valve in the by-pass conduit is programmed to open about 20 percent of the way in about 2.5 seconds, and the last 80 percent of the way in about 3.0 seconds, and the valve in the conduit to the waste gas purifier is programmed to close in about 4.0 seconds. These values will change depending upon system geometry, process conditions and the like.

Preferably, in the preferred hopcalite catalyst system, the hopcalite is in the form of a bed of pellets having a depth of greater than about one inch, through which the waste gas stream passes.

In adjusting the valve means in response to certain harmful conditions where there is a separate valve in the by-pass conduit and in the conduit to the purifier unit, it is desirable to have these two valves operate substantially simultaneously or in a programmed fashion such as described above wherein the pressure is carefully maintained at a substantially uniform level. In a preferred embodiment, the by-pass conduit is of such size that slightly greater pressure is produced in the by-pass conduit than is produced in the conduit to the waste gas purifier unit, when each of these conduits is the sole means of transport of the waste gas stream. It will be understood that there will ways of programming the valve means to control the pressure sufficiently to prevent process or equipment damage in the source of the waste gas stream and also to prevent damage to the waste gas purifier unit.

Figure 1:
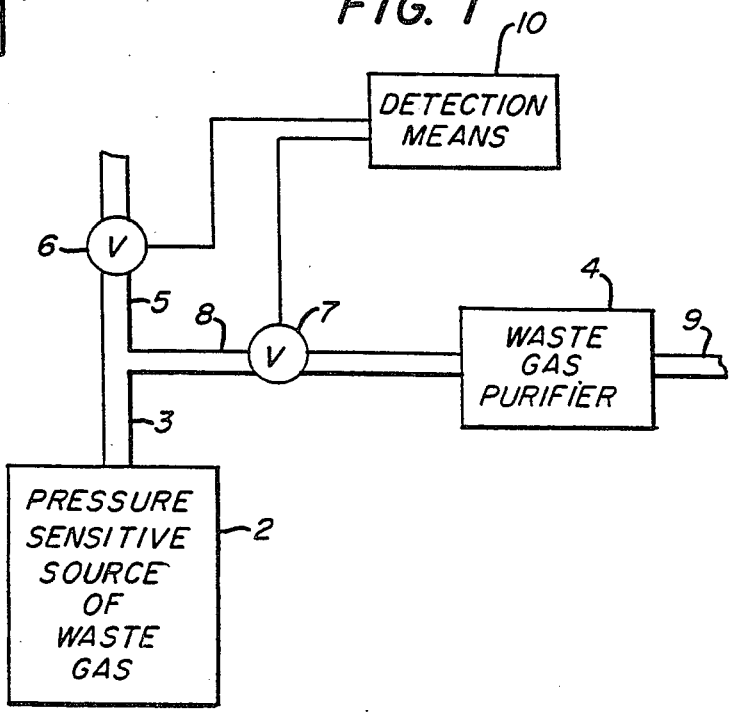
FIG. 1 is a schematic representation of the waste gas purification systems and methods of this invention.

In FIG. 1 a waste gas stream containing impurities is obtained from pressure sensitive source 2 of waste gases and passed into conduit 3. These gases normally pass to waste gas purifier via conduit 8, since vent valve 6 is closed and shutoff valve 7 is open. Detection means 10 upon sensing one or more predetermined conditions harmful to the waste gas purifier 4 adjusts valve 6 and 7 to stop the flow of gases to the waste gas purifier and causes the waste gases to flow through the by-pass conduit 5, and wherein the detection means 10 additionally comprises means for adjusting the valves 6 and 7 in a predetermined manner which maintains a substantially uniform pressure in the pressure sensitive source 2 during the adjustment of the valves 6 and 7. Valves 6 and 7 could be combined into a single valve means for accomplishing the same objective.

In FIG. 2 a waste gas stream from a production unit 1, such as a maleic anhydride production unit, passes through scrubber 2 where wash liquid such as water removes vapors, such as maleic anhydride, from the waste gas stream. The scrubber 2 is very sensitive to rapid changes in pressure. If the pressure is too high, equipment damage may result to the scrubber 2. Rapid pressure drops in the scrubber 2 can result in wash liquid being carried out of conduit 3 with resulting problems with the scrubber 2 and when the liquid is vented into the atmosphere and/or is passes into the catalytic oxidation unit.

Instrument air (or other gas) source 30 provides air pressure, of for example 15 psig, which is communicated to valves open. The waste gas stream then passes through conduit 8 and valve 7 to catalytic oxidation unit 4 where the oxidizable impurities such as hydrocarbons and carbon monoxide are oxidized prior to passing the purified waste gas stream through conduit 9

Upon a signal from detection means 10 for detecting one or more predetermined conditions harmful to the catalytic oxidation unit 4, an electrical signal to solenoids 11, 12 and 13 results in the closing of air valves 14 and 15 and the opening of air valve 16. Instrument air vented through air valve 16 allows vent valve 6 to begin to open at a rate determined by an air throttle valve 17 thereby allowing the waste gas stream to pass through by-pass conduit 5. Once limit switch 18 detects that the vent valve 6 has begun to open, and it is, therefore, relatively safe to close shut-off valve 7, an electrical signal to solenoid 19 opens air valve 20, which results in shut-off valve 7 closing at a rate set by air throttle valve 21. Vent valve 6 is caused to open slowly at first, such as during the first 20% of its travel, and then more rapidly, such as during the final 80% of its travel. The increased rate is triggered by switch 22 which responds to pressure loss in air conduit 31, which in turn signals solenoid 23 which opens air valve 24. Alternatively, the pressure loss in air conduit 32 could trigger the increased rate. By properly setting air throttle valve 25, the required opening rate for the final portion of the opening of vent valve 6 is obtained. Optional safety equipment is a rupture disc 26 to prevent overpressuring and a timer 27 which monitors the position of limit switch 28 to insure that the shut-off valve 7 closes when an emergency diversion has been signaled. If the shut-off valve 7 does not close in the prescribed time limit, a signal is sent to the compressor shut-down circuit 29 in order to halt the flow of gas to the scrubber 2.

Commercial catalytic oxidation units employing the systems and methods of this invention have been protected from catalyst damage for over 20 months of operation. Occasional emergency diversions have not caused any detectable equipment damage or harmful acid entrainment to the atmosphere.

We claim:

1. A waste gas stream control system comprising:
(1) a pressure sensitive means for emitting a waste gas stream;
(2) a first waste gas stream conduit having its inlet end connected to the source of the waste gas stream and downstream to a waste gas purifier,
(3) a second waste gas stream by-pass conduit having its inlet end connected to the source of the waste gas stream,
(4) valve means for controlling the waste gas stream flow through the first and second conduits,
(5) means responsive to one or more predetermined conditions harmful to the waste gas purifier to adjust the valve means to a by-pass condition to stop the flow of waste gases to the waste gas purifier and cause the waste gases to flow through the by-pass conduit, such means comprising means for adjusting the valve means in a predetermined manner which maintains a substantially uniform pressure in the pressure sensitive source of the waste gas stream.

2. System as in claim 1 wherein the waste gas purifier comprises means for catalytically oxidizing oxidizable pollutants from the waste gas stream.

3. System as in claim 2 wherein the source of a waste gas stream is a scrubber unit for the waste gas stream.

4. System as in claim 3 wherein the valve means comprises a separate valve in each of the first and second conduits.

5. System as in claim 4 wherein the predetermined conditions harmful to the waste gas purifier are (a) maximum level of oxidizable pollutants in the waste gas stream, (b) a maximum temperature in the waste gas stream, above which temperature would be harmful to the means for catalytically oxidizing the oxidizable pollutants in the waste gas stream, (c) a maximum pressure in the scrubber unit, above which pressure would be harmful to the scrubber unit, and in turn, if the scrubber unit were harmed could result in harm to the waste gas purifier, and (d) a minimum flow of scrubber liquid in the scrubber unit below which could result in added impurities in the waste gas stream.

6. System as in claim 5 wherein the substantially uniform pressure is such that the rate of flow of the waste gas stream through the scrubber unit does not increase by more than about 50%, and is not greater than about 50 psig.

7. System as in claim 5 wherein the means responsive to one or more predetermined conditions has the capability of sensing the harmful conditions and adjusting the valve means to stop the flow of waste gases to the waste gas purifier and cause the waste gases to flow through the by-pass conduit in a time period of less than about 30 seconds.

8. System as in claim 5 wherein the means for adjusting the valve means comprises:
(a) means for initiating beginning to slowly open the valve in the by-pass conduit,
(b) means responsive to the means for initiating the opening of the valve in the by-pass conduit for closing of the valve in the conduit to the waste gas purifier, and
(c) means responsive to the means for opening the valve in the conduit to the waste gas purifier for speeding up and opening of the valve in the by-pass conduit.

9. System as in claim 8 wherein the valve in the by-pass conduit is programmed to open about 20% of the way in about 2.5 seconds and the last 80% of the way in about 3.0 seconds, and wherein the valve in the conduit to the waste gas purifier is programmed to close in about 4.0 seconds.

10. A waste gas stream control system for removing oxidizable pollutants from a waste gas stream comprising: (1) a pressure sensitive scrubber unit for said waste gas stream, (2) a first gas stream conduit having its inlet end connected to the scrubber unit and downstream to a catalytic oxidation unit for the waste gas stream, (3) a second waste gas stream by-pass conduit having its inlet end connected to the scrubber unit for the waste gas stream and downstream to the atmosphere, (4) valve means for controlling the waste gas stream flow through the first and second conduits comprising separate valves in each of these conduits, (5) means responsive to one or more predetermined conditions harmful to the catalytic oxidation unit for the waste gas stream to adjust the valve means to a by-pass condition to stop the flow of waste gases to the catalytic oxidation unit and cause the waste gases to flow through the by-pass conduit, such means comprising means for adjusting the valve means in a predetermined manner which maintains a substantially uniform pressure in the scrubber unit, and wherein the means for adjusting the valve means is programmed to initiate the opening of the valve in the by-pass conduit, which, in turn, triggers the opening of the valve in the conduit to the catalytic oxidation unit, which in turn triggers the speeding up of the opening of the valve the balance of the way in the by-pass conduit.

11. System as in claim 10 wherein the waste gas stream originates from a maleic anhydride production unit attached to the scrubber unit.

12. System as in claim 11 wherein the means responsive to one or more predetermined conditions has the capability of sensing the harmful condition and changing the flow of gases from the conduit to the catalytic oxidation unit to the by-pass conduit in less than about 10 seconds.

13. System as in claim 11 wherein the harmful condition being sensed is a maximum amount of oxidizable pollutants in the waste gas stream.

14. Process for controlling a waste gas stream comprising:
(1) maintaining a substantially uniform pressure in a pressure sensitive source of a waste gas stream,
(2) passing said waste gas stream through a first conduit having its inlet end connected to the source of the waste gas stream and downstream to a waste gas purifier, and
(3) adjusting valves in the first conduit and in a second by-pass conduit connected to the source of the waste gas stream in response to one or more predetermined conditions harmful to the waste gas purifier to stop the flow of waste gases to the waste gas purifier and cause the waste gases to flow through the by-pass conduit, said adjusting of the valves being conducted in a predetermined manner which maintains a substantially uniform pressure in the pressure sensitive source of the waste gas stream.

15. Process as in claim 14 wherein the time between the sensing of the harmful conditions and the finishing of adjusting the valves is less than about 30 seconds.

16. Process as in claim 15 wherein the opening of the valve in the by-pass conduit is first begun slowly, which beginning triggers the closing of the valve in the first conduit to the waste gas purifier, and a predetermined loss of instrument air pressure triggers the more rapid opening of the valve in the by-pass conduit.

* * * * *